US011180293B2

(12) United States Patent
Sahara et al.

(10) Patent No.: US 11,180,293 B2
(45) Date of Patent: Nov. 23, 2021

(54) SYNTHETIC RESIN CONTAINER LID

(71) Applicant: NIPPON CLOSURES CO., LTD., Tokyo (JP)

(72) Inventors: Toru Sahara, Kanagawa (JP); Satoru Shimada, Kanagawa (JP); Takashi Sugiyama, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 368 days.

(21) Appl. No.: 16/325,263

(22) PCT Filed: Sep. 28, 2017

(86) PCT No.: PCT/JP2017/035278
§ 371 (c)(1),
(2) Date: Feb. 13, 2019

(87) PCT Pub. No.: WO2018/066451
PCT Pub. Date: Apr. 12, 2018

(65) Prior Publication Data

US 2019/0185226 A1 Jun. 20, 2019

(30) Foreign Application Priority Data

Oct. 6, 2016 (JP) ..... JP2016-198438

(51) Int. Cl.
*B65D 47/08* (2006.01)
*B65D 47/10* (2006.01)
*B65D 51/20* (2006.01)

(52) U.S. Cl.
CPC ..... *B65D 47/0804* (2013.01); *B65D 47/08* (2013.01); *B65D 47/0814* (2013.01); *B65D 47/103* (2013.01); *B65D 51/20* (2013.01)

(58) Field of Classification Search
CPC .. B65D 47/0814; B65D 47/103; B65D 51/20; B65D 47/08; B65D 47/0804; B65D 2251/0025; B65D 41/32
See application file for complete search history.

(56) References Cited

FOREIGN PATENT DOCUMENTS

JP 2006-315706 11/2006
JP 2007-022567 2/2007
(Continued)

OTHER PUBLICATIONS

Extended European Search Report dated May 28, 2020 for Application No. 17858289.6.

*Primary Examiner* — Anthony D Stashick
*Assistant Examiner* — L Kmet
(74) *Attorney, Agent, or Firm* — Smith, Gambrell & Russell, LLP.

(57) ABSTRACT

A synthetic resin container lid (2) has a shape including a body (4), which is mounted on a mouth-neck portion (56) of a container by locking a locking means (26) to a locked means (58) of the mouth-neck portion (56), and an upper lid (6) coupled to the body (4) via a hinge means (32). The synthetic resin container lid (2) is improved so that the entire container lid (2) is fully and easily detached from the mouth-neck portion of the container.
The axial depth of an annular or arcuate groove (46) formed in a hanging wall (10) of the body (4) and extending in a circumferential direction is changed as required. At least in a second break region (B) and a third break region (C), a circumferential breakable line (53) extending continuously in the circumferential direction along an axially lower end part of the groove (46) is formed in the hanging wall (10).

6 Claims, 10 Drawing Sheets

(56) References Cited

FOREIGN PATENT DOCUMENTS

| | | |
|---|---|---|
| JP | 2008-213924 | 9/2008 |
| JP | 2010-052773 | 3/2010 |
| JP | 2012-096802 | 5/2012 |

SYNTHETIC RESIN CONTAINER LID

TECHNICAL FIELD

This invention relates to a synthetic resin container lid of a shape including a body to be mounted on a mouth-neck portion of a container, and an upper lid coupled to the body via a hinge means, the synthetic resin container lid being configured such that after the contents of the container are consumed, the entire container lid can be detached from the container.

BACKGROUND ART

As is well known, a container lid of a shape, which includes a body to be mounted on a mouth-neck portion of a container, and an upper lid coupled to the body, and which has been molded from a suitable synthetic resin such as polypropylene or polyethylene, has been widely put to practical use as a container lid for a container accommodating a liquid seasoning or the like. The body has a circular closing wall, and a cylindrical hanging wall hanging down from the peripheral edge of the closing wall, and a locking means is formed in a lower end part of the inner peripheral surface of the hanging wall. The locking means is generally composed of an annular ridge extending continuously in a circumferential direction, or a plurality of arcuate ridges extending in the circumferential direction at intervals in the circumferential direction. The upper lid is coupled to an upper end part of the outer peripheral surface of the hanging wall of the body via a hinge means, and is pivotable between a closing position where the upper lid covers the closing wall of the body, and an opening position where the upper lid exposes the closing wall of the body. Such a container lid is mounted on the mouth-neck portion of the container by fitting the body onto the mouth-neck portion of the container, and locking the locking means formed in the hanging wall to a locking jaw formed on an outer peripheral surface of the mouth-neck portion of the container.

From the viewpoint of so-called segregated waste collection, it is desired that after the contents of the container are consumed, the entire container lid be detached from the mouth-neck portion of the container. Patent Document 1 cited below discloses a container lid improved so that the entire container lid can be detached from a mouth-neck portion of a container without the need to use a special tool or the like. In such a container lid, a hanging wall of a body of the container lid is formed with an axial breakable line located downstream of a hinge in a clockwise direction as viewed from above, and is also formed with an arcuate groove which is opened in an upper surface of the hanging wall and which extends in the circumferential direction from the axial breakable line toward an upstream side in the clockwise direction past the hinge means. The axial depth of the arcuate groove is sufficiently great, and a thin wall is allowed to remain below the arcuate groove. When the container lid is to be detached from the mouth-neck portion of the container after consumption of the contents of the container, the upper lid brought to the opening position is forced downward or upward to break the axial breakable line, whereafter the upper lid is forced toward the upstream side in the clockwise direction (namely, forced counterclockwise) to break the thin wall retained below the arcuate groove. By so doing, the hanging wall of the body is brought into a state where only a thin-walled part radially inward of the arcuate groove is allowed to remain partly in the circumferential direction. By moving an upper lid upward, for example, to force the hanging wall upward, therefore, a lower end part of the hanging wall is elastically deformed radially outwardly to disengage the locking means formed in the hanging wall upwardly from the locking jaw formed in the mouth-neck portion of the container. As a result, the body (namely, the entire container lid) can be detached, together with the upper lid, from the mouth-neck portion of the container.

PRIOR ART DOCUMENTS

Patent Documents

Patent Document 1: JP-A-2008-213924

SUMMARY OF THE INVENTION

Problems to be Solved by the Invention

The container lid disclosed in Patent Document 1 mentioned above can be detached from the mouth-neck portion of the container without the need to use a special tool or the like after the contents of the container are consumed. However, this container lid has not yet been sufficiently satisfactory, and has posed the following problem: Assume that the axial breakable line is broken, and then the thin wall allowed to remain below the arcuate groove is broken, as stated above. Even thereafter, it is likely that the detachment of the entire container lid from the mouth-neck portion of the container cannot be performed sufficiently easily, partly because the locking means formed in the hanging wall remains locked to the locking jaw formed in the mouth-neck portion of the container all over the circumferential direction.

The present invention has been accomplished in the light of the above facts. Its main technical challenge is to provide a novel and improved container lid which can be detached sufficiently easily from a mouth-neck portion of a container and which is of a shape including a body and an upper lid coupled to the body via a hinge means.

Means for Solving the Problems

Upon in-depth studies, the present inventors have found that the above main technical challenge can be solved by changing the axial depth of the annular or arcuate groove extending in the circumferential direction as required, and forming a circumferential breakable line along an axially lower end part of the groove.

That is, according to the present invention, there is provided, as a container lid for solving the above main technical challenge, a synthetic resin container lid which includes a body and an upper lid, and in which the body has a circular closing wall, and a cylindrical hanging wall hanging down from the peripheral edge of the closing wall, a locking means is formed in a lower end part of the inner peripheral surface of the hanging wall, and the upper lid is coupled to an upper end part of the outer peripheral surface of the hanging wall of the body via a hinge means, and is pivotable between a closing position where the upper lid covers the closing wall of the body, and an opening position where the upper lid exposes the closing wall of the body, wherein an annular or arcuate groove opened in an upper surface of the hanging wall and extending in a circumferential direction is formed in the hanging wall of the body, an axial breakable line extending axially in a part radially outward of the groove in the hanging wall is disposed in a region which is downstream of the hinge means in a clockwise direction and where the groove is formed, the axial depth of the groove is great, and the axial remaining thickness of the hanging wall is small or zero, in a first break region extending in the circumferential direction from the axial breakable line toward an upstream side in the clockwise direction past the hinge means as far as a predetermined position; in a second break region following the first break region and extending in the circumferential direction toward the upstream side in the clockwise direction, the axial depth of the groove gradually decreases, while the axial remaining thickness of the hanging wall gradually increases; and in a third break region following the second break region and extending in the circumferential direction toward the upstream side in the clockwise direction, the axial depth of the groove is small, while the axial remaining thickness of the hanging wall is great, at least in the second break region and the third break region, a circumferential breakable line extending continuously in the circumferential direction along an axially lower end part of the groove is formed in the hanging wall, and in the first break region, the axially lower end of the groove is located below the locking means in the axial direction, whereas in the third break region, the circumferentially breakable line is located above the locking means in the axial direction.

Preferably, the first break region extends in the circumferential direction over an angular range of 40 to 100 degrees, the second break region extends over an angular range of 10 to 30 degrees, and the third break region extends over an angular range of 140 to 300 degrees. It is preferred that the axial remaining thickness in the first break region be 0 to 1.0 mm, that the axial remaining thickness in the second break region be 0.6 mm or more, and that the axial remaining thickness in the third break region be 4.0 mm or more. Preferably, the axial remaining thickness sharply increases at the boundary between the first break region and the second break region. It is advantageous that upstream of the third break region in the clockwise direction, there be a non-break region where the axial depth of the groove is even smaller and the axial remaining thickness of the hanging wall is even larger. In the second break region, the axial remaining thickness preferably changes along an oblique line extending axially upwardly at an inclination angle of 20 to 60 degrees toward the upstream side in the clockwise direction.

Effects of the Invention

With the container lid of the present invention, when the container lid is to be detached from the mouth-neck portion of the container, the upper lid placed at the opening position is forced upward or downward to break the axial breakable line, and then the upper lid is moved toward the upstream side in the clockwise (i.e., counterclockwise) as viewed from above. By so doing, the circumferential breakable line extending continuously in the circumferential direction is broken. In the third break region, therefore, the locking means located below the circumferential breakable line in the axial direction is disengaged from the locking jaw of the mouth-neck portion of the container. Hence, by moving the upper lid upward, for example, the entire container lid can be detached from the mouth-neck portion of the container sufficiently easily.

MODE FOR CARRYING OUT THE INVENTION

The present invention will now be described in further detail by reference to the accompanying drawings showing a preferred embodiment of a synthetic resin container lid configured in accordance with the present invention.

With reference to FIGS. 1 to 4, a container lid entirely indicated at a numeral 2 includes a body 4 and an upper lid 6. Such a container lid 2 can be advantageously formed by injection- or compression-molding a suitable synthetic resin, such as polypropylene or polyethylene, integrally as a whole.

Figure 1:
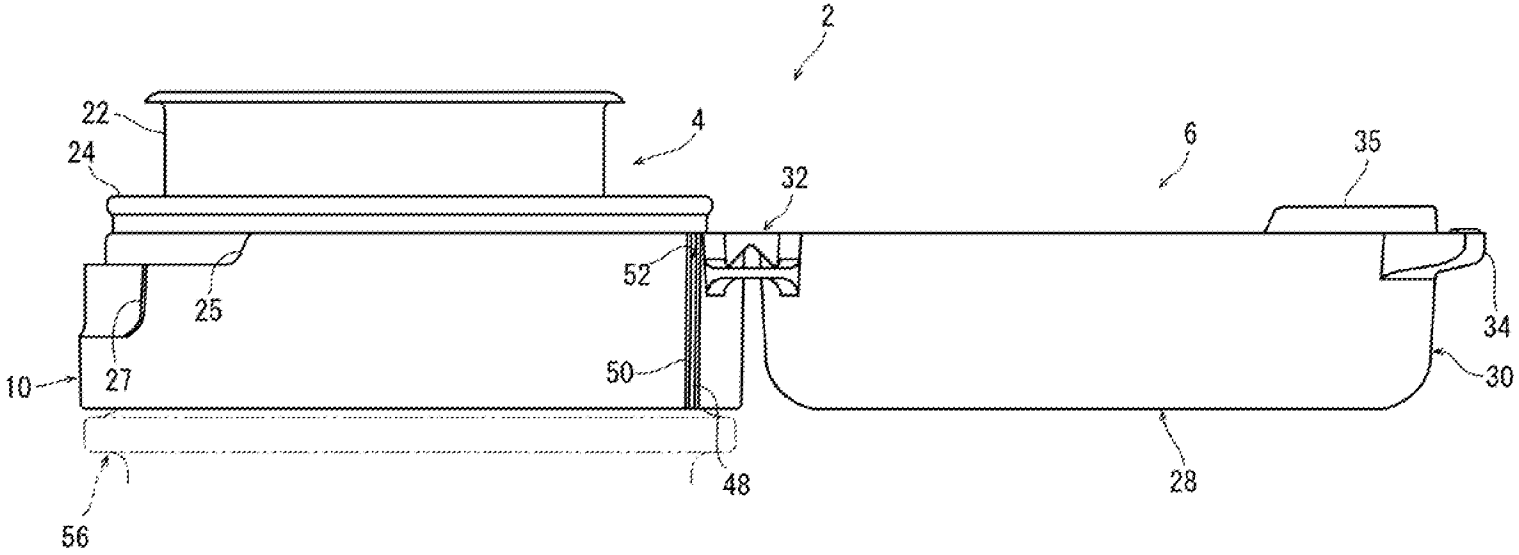
FIG. 1 is a side view showing a preferred embodiment of a synthetic resin container lid, configured in accordance with the present invention, in a state molded within a forming mold.
Figure 2:
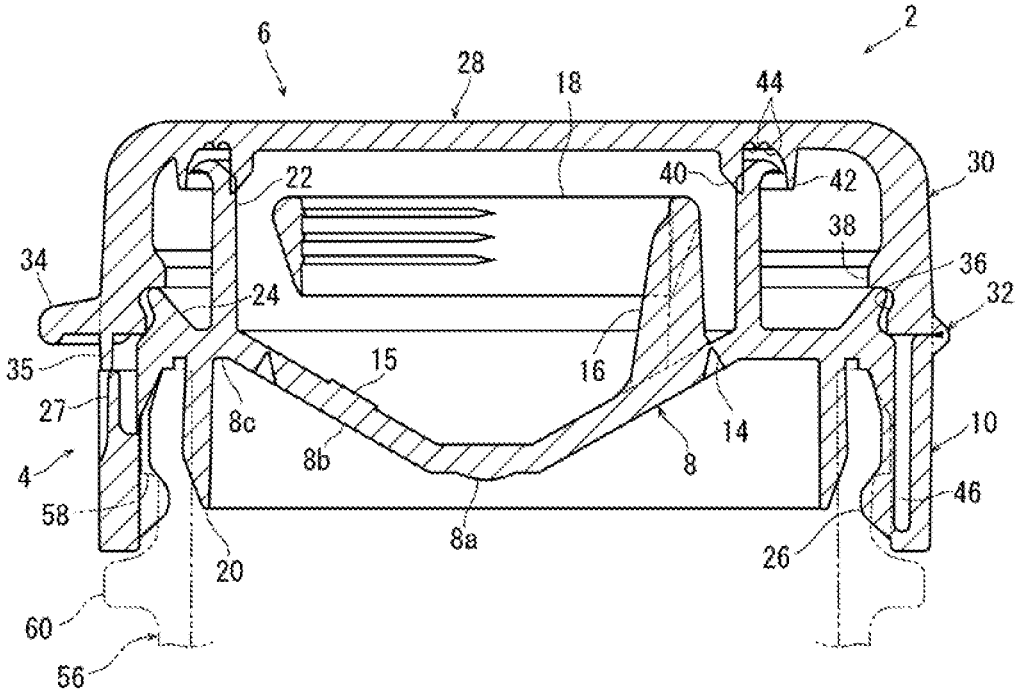
FIG. 2 is a sectional view of the synthetic resin container lid shown in FIG. 1, with an upper lid being brought to a closing position.
Figure 3:
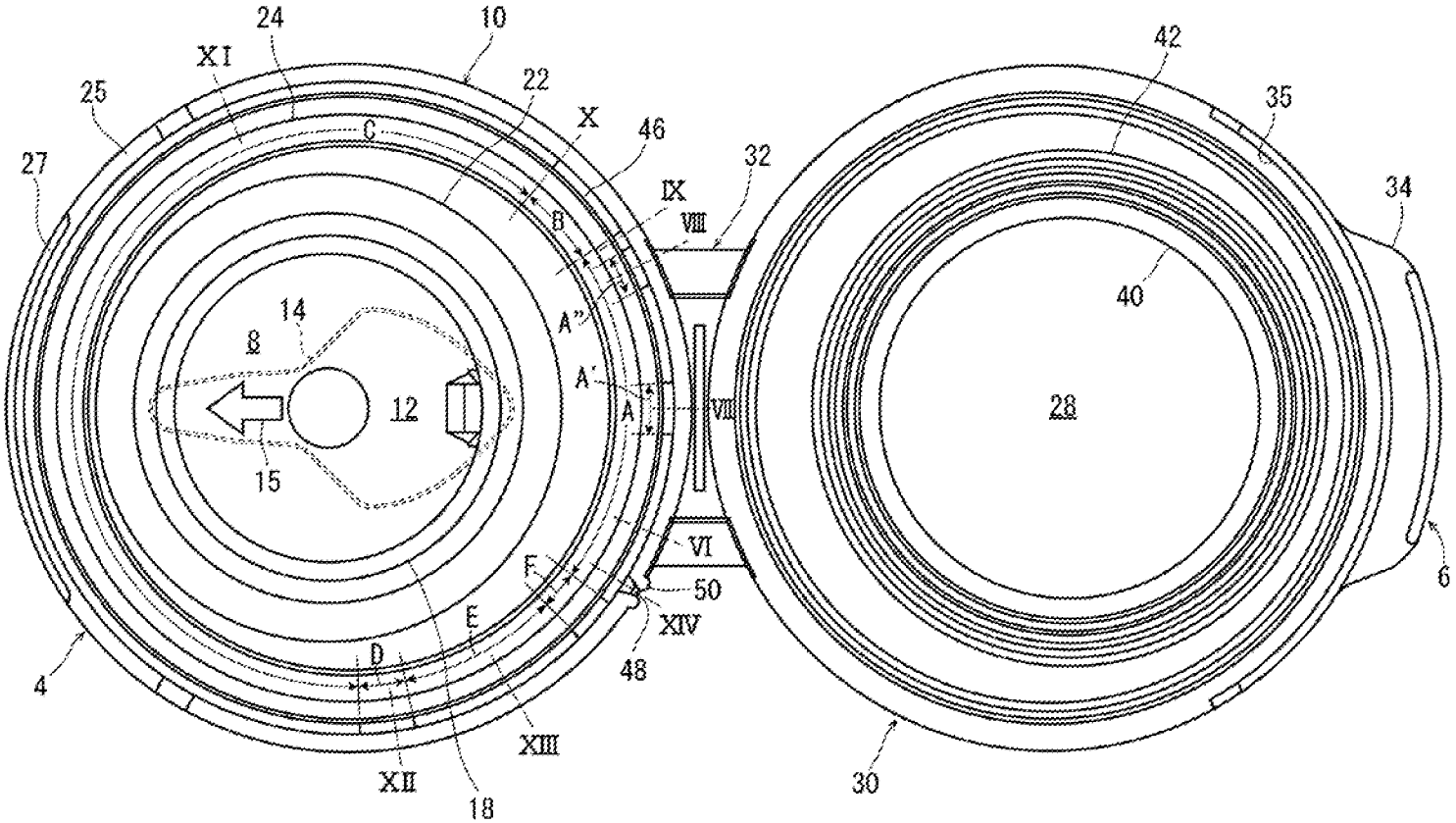
FIG. 3 is a plan view of the synthetic resin container lid shown in FIG. 1.
Figure 4:
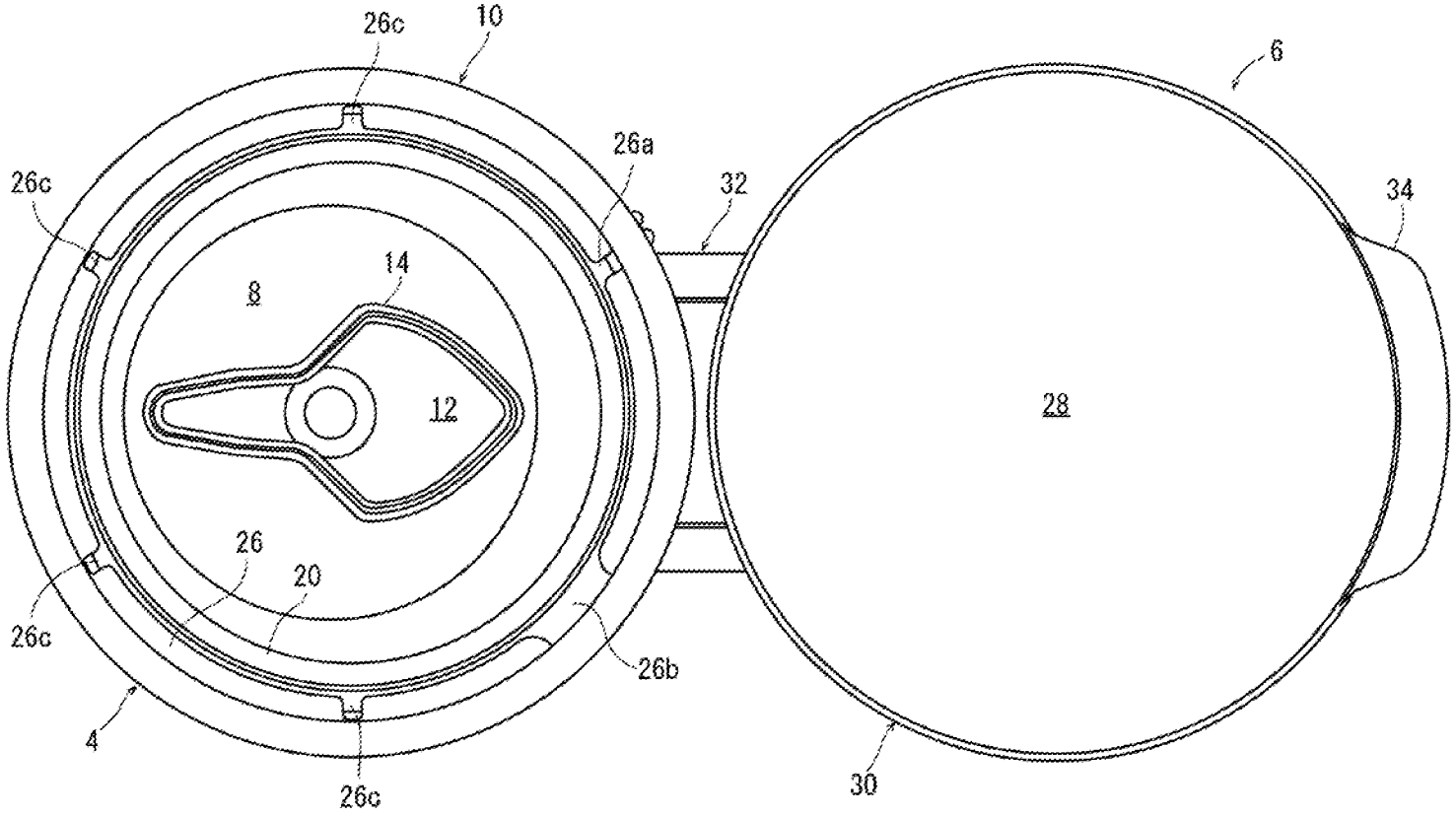
FIG. 4 is a bottom view of the synthetic resin container lid shown in FIG. 1.

Mainly by reference to FIG. 2, the body 4 has a closing wall 8 circular when viewed from above, and a hanging wall 10 hanging down substantially vertically from the peripheral edge of the closing wall 8. The closing wall 8 is composed of a central part 8*a* extending substantially horizontally, an intermediate part 8*b* of an inverted frusto-conical cylindrical shape extending from the central part 8*a* radially outwardly in an upwardly inclined manner, and an outer peripheral part 8*c* following the intermediate part 8*b* and extending radially outwardly in a substantially horizontal manner. The intermediate part 8*b* of the closing wall 8 is formed with a breakable line 14 defining a removal region 12 (reference to FIGS. 3 and 4 is requested). As will be clearly understood by reference to FIGS. 3 and 4, the removal region 12 in the illustrated embodiment is composed of a deformed quadrilateral part located on one side in a radial direction, and a deformed triangular part extending from the deformed quadrilateral part to the other side in the radial direction. As will be clearly understood by reference to FIG. 2, the breakable line 14 is composed of so-called scores formed by locally decreasing the thickness. On an upper surface of the removal region 12, an arrow-shaped protrusion 15 is formed. A coupling column 16 which extends upward is disposed on one side of the upper surface of the deformed triangular part of the removal region 12, and a pull ring 18 is coupled to the upper end of the coupling column 16. A cylindrical sealing piece 20 which hangs down is formed on a lower surface of the outer peripheral part 8*c* of the closing wall 8. On the other hand, a nearly cylindrical guide tube 22 which extends upward is formed on an upper surface of the outer peripheral part 8*c* of the closing wall 8. As will be clearly understood by reference to FIGS. 2 and 3, the guide tube 22 is not concentric in the closing wall 8, but is rendered eccentric somewhat leftward in FIGS. 2 and 3. A leading end part of the guide tube 22 is protruded radially outwardly in an arcuate form. The outer peripheral part 8*c* of the closing wall 8 is further formed with an annular locking piece 24 protruding radially outwardly in an upwardly inclined manner radially outwardly of the guide tube 22. A locking means 26 is disposed in a lower end part of the inner peripheral surface of the hanging wall 10. In the illustrated embodiment, the locking means 26 is composed of a plurality of arcuate ridges extending in the circumferential direction at intervals in the circumferential direction. If desired, the locking means 26 can be constituted by an annular ridge extending continuously in the circumferential direction. As will be clearly understood by reference to FIGS. 1 and 3, at a predetermined angular site of the hanging wall 10 (a site on a side diametrically opposite to a hinge means to be described later), a notch 25 extending arcuately is formed in an upper part of the hanging wall 10. Below the notch 25, a shallow concavity 27 extending arcuately is formed on the outer peripheral surface of the hanging wall 10.

Further by reference to FIGS. 1 to 4, the upper lid 6 is composed of a circular top panel wall 28 and a skirt wall 30 handing down from the periphery of the top panel wall 28 (in a state where the upper lid 6 is located at a closing position shown in FIG. 2). At a predetermined angular site, a lower end part of the skirt wall 30 is pivotably coupled to the outer peripheral surface of the hanging wall 10 of the body 4 via a hinge means 32 which itself may be in a well-known suitable form, and is pivotally moved to open and close between the closing position shown in FIG. 2 and an opening position at which the upper lid is pivoted, for example, at an angle of the order of 100 degrees from the closing position. When the upper lid 6 is brought to the closing position, the closing wall 8 of the body 4 is covered with the upper lid 6. When the upper lid 6 is brought to the opening position, the closing wall 8 of the body 4 is exposed. A protruding piece 34 protruding radially outwardly is disposed at a site diametrically opposite to the hinge means 32 in the lower end part of the outer peripheral surface of the skirt wall 30. When the upper lid 6 is pivotally moved to open or close, a finger can be hooked on the protruding piece 34. Further, a thin-walled arcuate protruding piece 35 protruding downward is formed at a site diametrically opposite to the hinge means 32 on the lower surface of the skirt wall 30. An annular locking ridge 36 is disposed at the lower end of the inner peripheral surface of the skirt wall 30, and an annular contact ridge 38 located above the annular locking ridge 36 is also disposed on the inner peripheral surface of the skirt wall 30. Two annular sealing pieces 40 and 42 protruding downward are disposed on the inner surface of the top panel wall 28. The two annular sealing pieces 40 and 42 are rendered somewhat eccentric leftward in FIG. 2 and rightward in FIG. 3 with respect to the center of the top panel wall 28, in correspondence with the eccentricity of the guide tube 22 in the body 4. Two annular shallow grooves 44, 44 are formed in a region between the two annular sealing pieces 40 and 42 in the inner surface of the top panel wall 28. As will be clearly understood by reference to FIG. 2, when the upper lid 6 is placed at the closing position, the annular locking ridge 36 of the upper lid 6 is locked to the outer peripheral surface to lower surface of the annular locking piece 24 of the body 4, the annular contact ridge 38 of the upper lid 6 is brought into contact with the upper end of the annular locking piece 24 of the body 4, the protruding piece 35 of the upper lid 6 is positioned within the notch 25 of the body 4, and the annular sealing pieces 40 and 42 of the upper lid 6 are brought into intimate contact with, or proximity to, the inner peripheral surface and outer peripheral surface of the guide tube 22 of the body 4.

The foregoing features in the illustrated container lid configured in accordance with the present invention do not constitute the novel characteristics of the present invention, but may themselves be in well-known forms, and they show a typical example of the container lid to which the present invention is applied. Thus, detailed descriptions of these features will be omitted herein.

Figure 14:
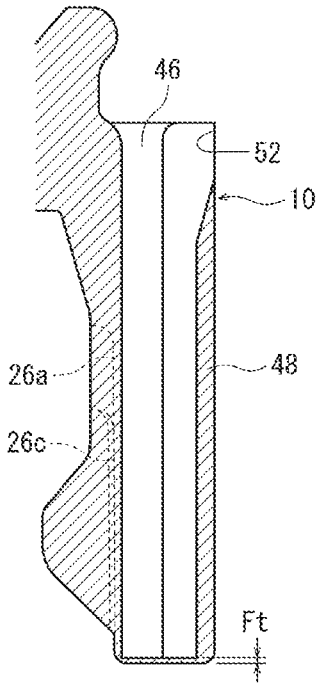
FIG. 14 is a partial sectional view taken on line XIV-XIV in FIG. 3.

Referring to FIG. 3, it is important that an annular or arcuate groove 46, which is opened in the upper surface of the hanging wall 10 (in other words, which extends downward from the upper surface of the hanging wall 10) and which extends in the circumferential direction in FIG. 3 (accordingly, when viewed from above), be formed in the hanging wall 10 of the body 4. In the illustrated embodiment, the groove 46 is annular. If desired, the groove 46 can be formed into an arcuate shape extending from a starting point, which is located downstream of the hinge means 32 in the clockwise direction and downstream of an axial breakable line (to be described later) in the clockwise direction, toward the upstream side in the clockwise direction past the hinge means 32. In this case, it is advantageous for the groove 46 to extend continuously over an angle of 300 to 360 degrees. It is important that an axial breakable line 48 extending axially in a part radially outward of the groove 46 in the hanging wall 10 be disposed in a region which is downstream of the hinge means 32 in the clockwise direction and where the groove 46 is formed (the term "clockwise direction" used herein refers to the clockwise direction in FIG. 3, in other words, as viewed from above). The axial breakable line 48 is located near the hinge means 32, and extends axially from the upper end to the lower end of the hanging wall 10. As will be understood by reference to FIGS. 4 and 14, the locking ridges constituting the locking means 26 are not present at the angular position where the axial breakable line 48 is formed. Moreover, the axially upper end position of a concave site 26*a* formed between the locking ridges is somewhat above the axially upper end position of a concave site 26*c* formed between the locking ridges in a third break region to be described later (this positioning is schematically shown in FIG. 14).

Figure 5:
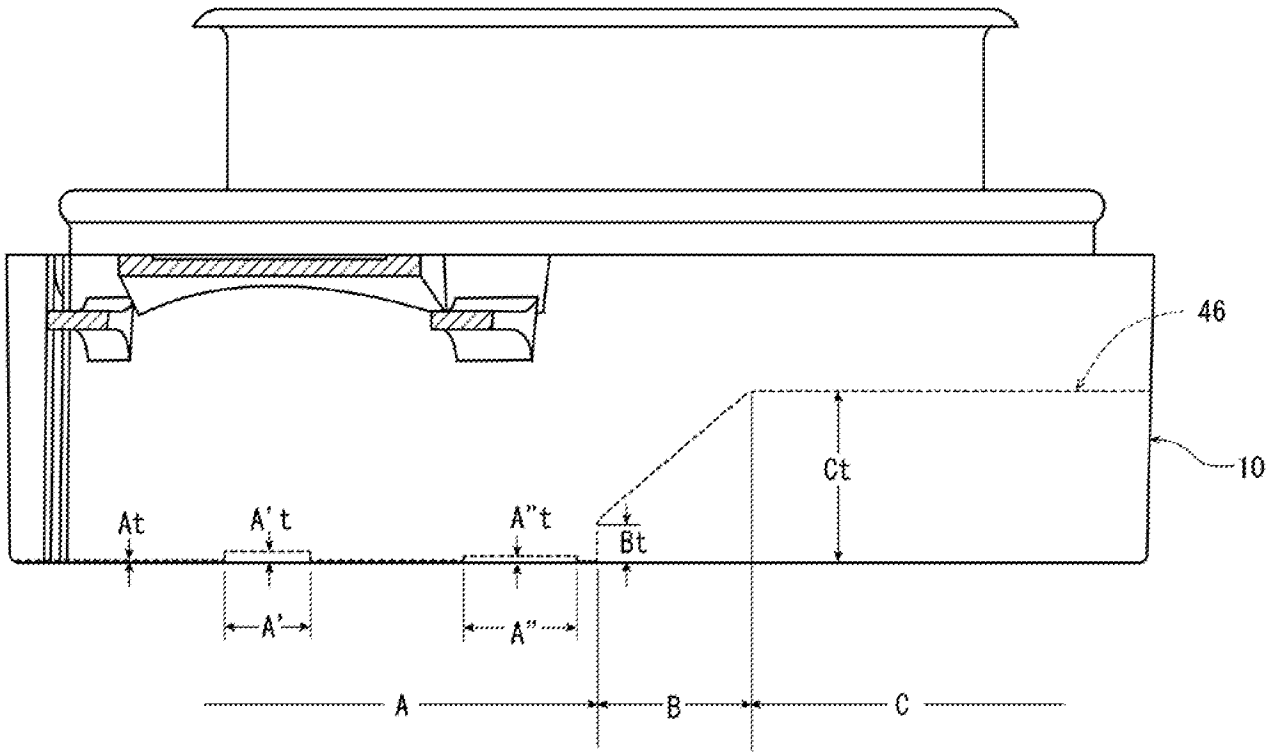
FIG. 5 is a side view of the synthetic resin container lid shown in FIG. 1, with an upper lid being omitted.
Figure 6:
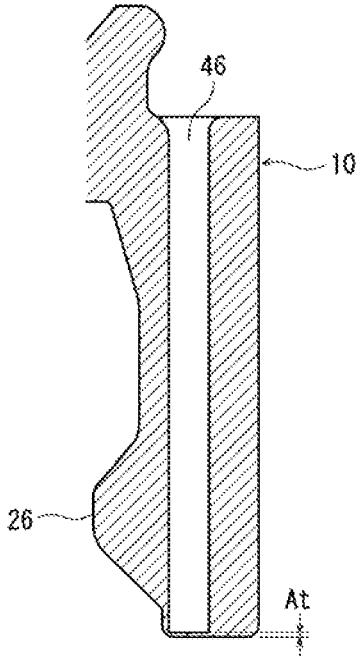
FIG. 6 is a partial sectional view taken on line VI-VI in FIG. 3.
Figure 7:
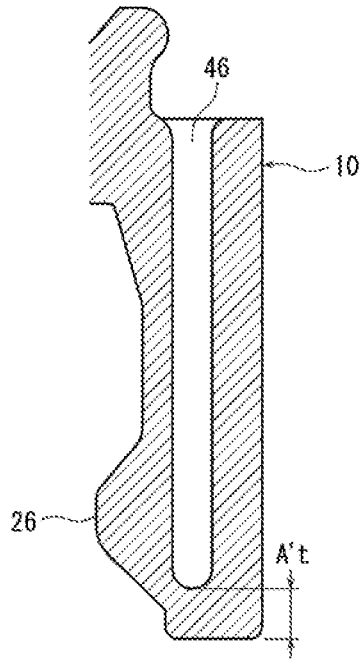
FIG. 7 is a partial sectional view taken on line VII-VII in FIG. 3.
Figure 8:
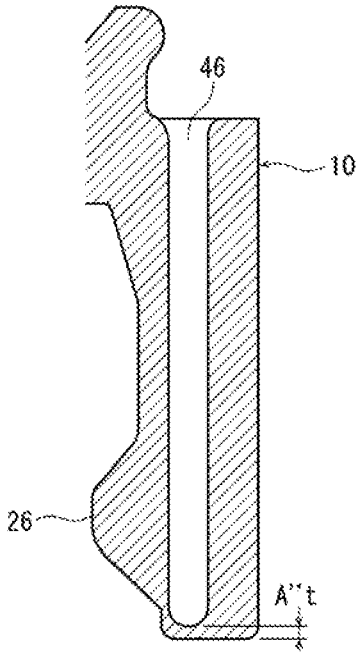
FIG. 8 is a partial sectional view taken on line VIII-VIII in FIG. 3.

The groove 46 will be described in further detail. It is important for the groove 46 that in a first break region indicated by a symbol A in FIG. 3, the groove 46 is deep, and the axial remaining thickness of the hanging wall 10 is small or zero; in a second break region indicated by a symbol B in FIG. 3, the groove 46 becomes gradually shallow toward the upstream side in the clockwise direction, and the axial remaining thickness of the hanging wall 10 gradually increases; in a third break region indicated by a symbol C in FIG. 3, the groove 46 is shallow, and the axial remaining thickness of the hanging wall 10 is great; in the first break region A, the axially lower end of the groove 46 is located axially below the locking means 26; and in the third break region C, the axially lower end of the groove 46 is located axially above the locking means 26. Importantly, the first break region A extends in the circumferential direction from the axial breakable line 48 toward the upstream side in the clockwise direction past the hinge means 32 as far as a required position, preferably over an angular range of 40 to 100 degrees; the second break region B follows the first break region A and extends toward the upstream side in the clockwise direction, preferably over an angular range of 10 to 30 degrees; and the third break region C follows the second break region B and extends in the circumferential direction toward the upstream side in the clockwise direction, preferably over an angular range of 140 to 300 degrees. In the illustrated embodiment, as clearly understandable by reference to FIGS. 5 and 6, in the first break region A, with the exception of regions indicated by symbols A' and A" in FIG. 3, namely, the region located circumferentially centrally of the hinge means 32 and the region located at the upstream end of the first break region A in the clockwise direction, the depth of the groove 46 is markedly great, and the axial remaining thickness At of the hanging wall 10 is markedly small, for example, 0 to 0.2 mm. If desired, it is possible to make the remaining thickness At of the hanging wall 10 zero, namely, to define the groove 46 in such a manner as to penetrate the hanging wall 10 in the axial direction. In the region indicated by the symbol A' in the first break region A, as shown in FIGS. 5 and 7, the depth of the groove 46 is sufficiently large, while the axial remaining thickness A't of the hanging wall 10 is sufficiently small, for example, 0.2 to 1.0 mm, and slightly larger than the above thickness At. In the region indicated by the symbol A" in the first break region A as well, as shown in FIGS. 5 and 8, the depth of the groove 46 is sufficiently large, while the axial remaining thickness A"t of the hanging wall 10 is sufficiently small, for example, 0.1 to 0.5 mm, and slightly larger than the above thickness At. In the region A' and the region A", the axial remaining thicknesses of the hanging wall 10 need not necessarily be slightly increased to A't and A"t, respectively, and if desired, even in the regions A' and A", the remaining thickness of the hanging wall 10 can be made At. As will be clearly understood by reference to FIGS. 5 to 8, in the first break region A, the axially lower end of the groove 46 is located below the locking means 26.

Figure 9:
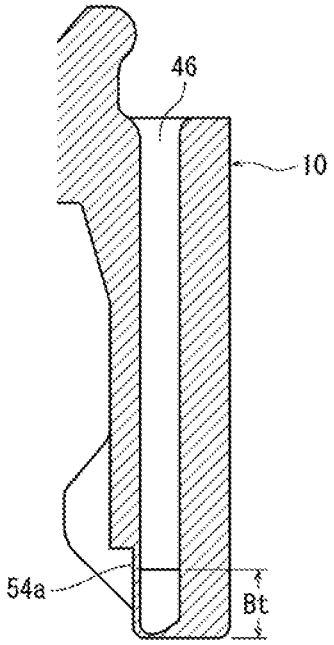
FIG. 9 is a partial sectional view taken on line IX-IX in FIG. 3.

In the illustrated embodiment, as will be understood by reference to FIG. 5, at the boundary between the first break region A and the second break region B, the depth of the groove 46 sharply decreases, and the axial remaining thickness of the hanging wall 10 sharply increases to Bt which preferably is 0.6 mm or more (thus, the axial remaining thickness Bt in the second break region B is 0.6 mm or more). The circumferential position of the boundary between the first break region A and the second break region B is symmetrical to the circumferential position of the axial breakable line 48 with respect to the central line extending in a right and left direction in FIG. 3. In the second break region B, as will be understood by reference to FIGS. 9 and 10 along with FIG. 5, the depth of the groove 46 is gradually decreased toward the upstream side in the clockwise direction, and the axial remaining thickness of the hanging wall 10 is gradually increased from Bt to Ct. The increase in the axial remaining thickness of the hanging wall 10 from Bt to Ct preferably changes along an oblique line inclined upward at an inclination angle of 20 to 60 degrees toward the upstream side in the clockwise direction. The lower end of the groove 46 in the third break region C is located above the locking means 26. It is advantageous, therefore, that the axial remaining thickness Ct of the hanging wall 10 be 4.0 mm or more.

Figure 10:
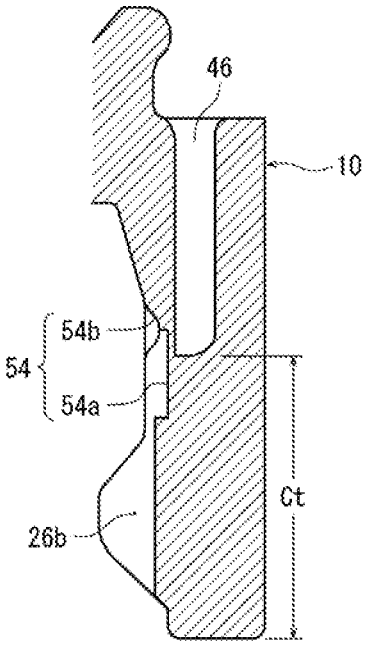
FIG. 10 is a partial sectional view taken on line X-X in FIG. 3.
Figure 11:
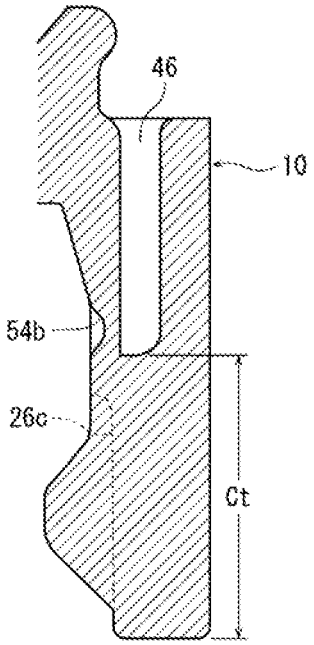
FIG. 11 is a partial sectional view taken on line XI-XI in FIG. 3.
Figure 12:
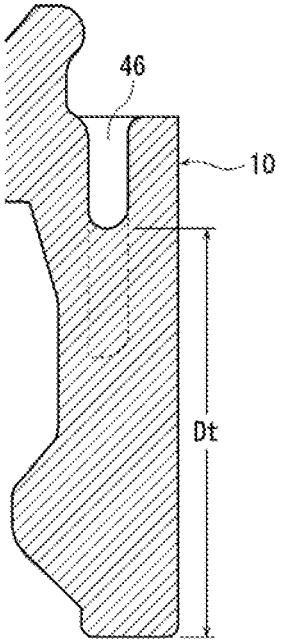
FIG. 12 is a partial sectional view taken on line XII-XII in FIG. 3.
Figure 13:
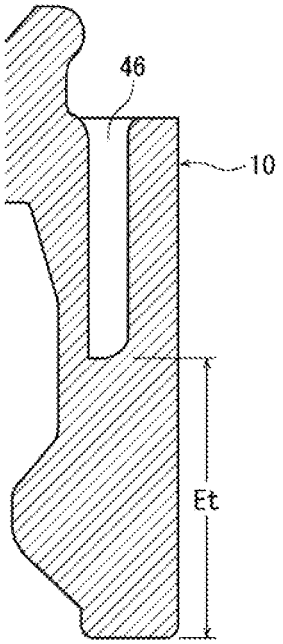
FIG. 13 is a partial sectional view taken on line XIII-XIII in FIG. 3.

As will be understood by reference to FIGS. 10 and 11, in the third break region C, the depth Ct of the groove 46 does not change, but is maintained constant. In the illustrated embodiment, a non-break region D is present upstream of the third break region C in the clockwise direction. As illustrated in FIG. 12, in the non-break region D, the depth of the groove 46 is further decreased, and the axial remaining thickness Dt of the hanging wall 10 is further increased. Advantageously, the non-break region D is present over an angular range of 5 to 20 degrees, and the axial remaining thickness Dt of the hanging wall 10 is of the order of 5.0 to 9.0 mm. Furthermore, an additional non-break region E is present upstream of the non-break region D in the clockwise direction. In the additional non-break region E, as shown in FIG. 13, the depth of the groove 46 is rendered larger than its depth in the non-break region D, but is sufficiently small, and the axial remaining thickness Et of the hanging wall 10 is sufficiently large. The additional non-break region E is present over an angular range of 10 to 50 degrees, and the axial remaining thickness Et of the hanging wall 10 may be substantially the same as the axial remaining thickness Ct of the hanging wall 10 in the third break region C. In a region F present between the additional non-break region E and the axial breakable line 48, the groove 46 is markedly deep, and the axial remaining thickness Ft of the hanging wall 10 may be substantially the same as the axial remaining thickness At of the hanging wall 10 in the first break region A. If desired, in the additional non-break region E and/or the region F, the groove 46 may be omitted, so that the groove 46 can be in an arcuate form, rather than an annular form extending over 360 degrees.

By reference to FIGS. 3, 5 and 14, the axial breakable line 48 can be constituted by locally reducing the wall thickness of a part radially outward of the groove 46 in the hanging wall 10. In the illustrated embodiment, the axial breakable line 48 is constituted by forming an axially extending recessed line 50 in each of the inner and outer surfaces of the part radially outward of the groove 46 in the hanging wall 10, and further forming a notch 52 in the axially upper end part. Since the axial breakable line 48 is constituted by the recessed lines 50 and the notch 52, the visibility of the axial breakable line 48 becomes satisfactory. As will be described later, moreover, when the axial breakable line 48 is broken, axial breakage along the valley part of the recessed line 50 can be performed reliably. If desired, it is also possible to constitute the axial breakable line 48, for example, by forming a plurality of slits (cuts) at axial intervals in the part radially outward of the groove 46 in the hanging wall 10.

Figure 15:
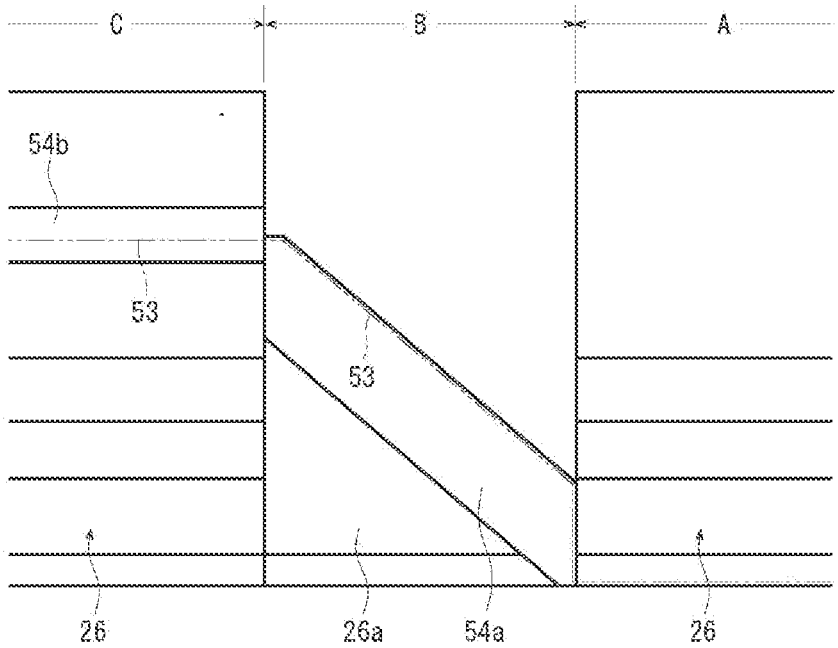
FIG. 15 is a partial schematic view showing a thin-walled portion formed in a body of the synthetic resin container lid shown in FIG. 3.

In the hanging wall 10 of the body 4, it is important that a circumferential breakable line 53 extending continuously in the circumferential direction along an axially lower end part of the groove 46 be further formed at least in the second break region B and the third break region C. In the illustrated embodiment, the circumferential breakable line 53 extending continuously in the circumferential direction from the lower end of the axial breakable line 48 is composed of a part in the hanging wall 10 where the axial remaining thickness At allowed to remain at the lower end of the groove 46 in the first break region A is sufficiently small, and a thin-walled portion 54 defined by locally increasing the inner diameter of the hanging wall 10 in the second break region B and the third break region C. The thin-walled portion 54 is further composed of a thin-walled portion **54*a*** and a thin-walled portion 54*b*. In further detail, as will be clearly understandable by reference to FIGS. 4 and 15, in the second break region B, the locking ridge constituting the locking means 26 does not exist, but a concave site 26*b* formed between the locking ridges is located. In the concave site 26*b*, there is formed the thin-walled portion (a site where the inner diameter is locally decreased) 54*a* extending along an axially lower end part of the groove 46 inclined upward toward the upstream side in the clockwise direction. As will be understood by reference to FIG. 10 along with FIG. 15, a recessed groove defining the thin-walled portion 54*a* has a rectangular cross-sectional shape. To proceed smoothly with the breakage (as will be described in detail later) over the first break region A and the second break region B, the thin-walled portion 54*a* is preferably extended slightly as far as an upstream end part of the first break region A in the clockwise direction. In the third break region C, the thin-walled portion 54*b* is formed which follows the upper end part of the thin-walled portion 54*a* and extends along the axially lower end part of the groove 46 in the circumferential direction toward the upstream side in the clockwise direction. In the third break region C, the axially lower end of the groove 46 extends substantially horizontally, so that the thin-walled portion 54*b* also extends substantially horizontally. As will be clearly illustrated in FIGS. 10 and 11, the cross-sectional shape of a recessed groove defining the thin-walled portion 54*b* is nearly crescent. As will be clearly understandable by reference to FIGS. 4 and 11, in the third break region C, the locking ridge constituting the locking means 26 is not present, and the axially upper end positions of the concave sites 26*c* formed between the locking ridges are located below the thin-walled portion 54*b*. The radial thicknesses of sites radially inward of the groove 46 of the hanging wall 10 in the thin-walled portion 54*a* and thin-walled portion 54*b* constituting the thin-walled portion 54 are preferably of the order of 0.05 to 0.5 mm.

FIG. 2 shows the container lid 2 constituted in accordance with the present invention, and also a mouth-neck portion of a container to which the container lid 2 is applied. A mouth-neck portion 56 of a container which can be formed from a suitable synthetic resin or glass is in a cylindrical shape having an open upper surface, and a locked ridge 58 is formed in an upper end part of its outer peripheral surface. The outer peripheral surface of the mouth-neck portion 56 is further formed with a support ring 60 (the support ring 60 is utilized when the container is transported) located below the locked ridge 58.

After contents are accommodated within the container, the container lid 2 is mounted on the mouth-neck portion 56 to seal the mouth-neck portion 56. For this sealing, the container lid 2 with the upper lid 6 brought to the closing position is fitted onto the mouth-neck portion 56, and forced downward, whereby the body 4 is elastically deformed, and the locking means 26 formed on the inner peripheral surface of the hanging wall 10 is locked below the locked ridge 58 of the mouth-neck portion 56. In consuming the contents of the container, it is a first step to pivotally move the upper lid 6 to the opening position, thereby exposing the closing wall 8 of the body 4. Then, a finger is hooked on the pull ring 18 of the body 4, and the pull ring 18 is forced upward to break the breakable line 14 and remove the removal region 12 from the closing wall 8, thus creating a discharge opening. Thereafter, the container is appropriately tilted to be capable of discharging the contents of the container through the discharge opening.

After the contents of the container are consumed, the entire container lid 2 is detached from the mouth-neck portion 56 for so-called segregated collection of wastes. On this occasion, the upper lid 6 placed at the opening position is gripped and, in the illustrated embodiment, forced downward at the site of formation of the axial breakable line 48 to break the axial breakable line 48. Then, the upper lid 6 is forced toward the upstream side in the clockwise direction to break the circumferential breakable line 53. On this occasion, in the first break region A, the part of the sufficiently small thickness At allowed to remain below the groove 46 in the hanging wall 10 is broken. As a result, the part radially outward of the groove 46 all over the axial direction of the hanging wall 10 is separated from the part radially inward of the groove 46 and moved radially outwardly. At the boundary between the first break region A and the second break region B, the axial remaining thickness sharply increases, so that the breakage of the hanging wall 10 is smoothly shifted from the first break region A to the second break region B. In the second break region B, the thin-walled portion 54*a*, more detailedly, the upper edge part of the thin-walled portion 54*a* is broken, as indicated by a dashed double-dotted line in FIG. 15. Hence, axially below the above broken part of the thin-walled portion 54*a*, the entire hanging wall 10 is moved radially outwardly and, axially above the above broken part of the thin-walled portion 54*a*, the part radially outward of the groove 46 is moved radially outwardly. Then, in the third break region C, the thin-walled portion 54*b*, more detailedly, a vertically nearly middle part of the thin-walled portion 54*b* is broken, as indicated by the dashed double-dotted line in FIG. 15. Hence, axially below the above broken part of the thin-walled portion 54*b*, the entire hanging wall 10 is moved radially outwardly and, axially above the above broken part of the thin-walled portion 54*b*, the part radially outward of the groove 46 is moved radially outwardly. In the third break region C, the thin-walled portion 54*b* is located above the locking means 26. In the third break region C, therefore, the locking means 26 is also moved radially outwardly, and separated from the mouth-neck portion 56 of the container. Thereafter, the upper lid 6 is forced upward, whereby the entire container lid 2 can be detached from the mouth-neck portion 56 sufficiently easily. In the non-break region D located upstream of the third break region C in the clockwise direction, a thin-walled portion is not disposed, and the depth of the groove 46 is small. Accordingly, breakage does not proceed.

EXPLANATIONS OF LETTERS OR NUMERALS

2: Container lid
4: Body
6: Upper lid
8: Closing wall
10: Hanging wall
26: Locking means
28: Top panel wall
30: Skirt wall
32: Hinge means
46: Groove
48: Axial breakable line
53: Circumferential breakable line
54: Thin-walled portion
54*a*: Thin-walled portion
54*b*: Thin-walled portion
56: Mouth-neck portion of container
58: Locked ridge
A: First break region
B: Second break region C: Third break region D: Non-break region

The invention claimed is:

1. A synthetic resin container lid which includes a body and an upper lid, and in which the body has a circular closing wall, and a cylindrical hanging wall hanging down from a peripheral edge of the closing wall, a locking means is formed in a lower end part of an inner peripheral surface of the hanging wall, and the upper lid is coupled to an upper end part of an outer peripheral surface of the hanging wall of the body via a hinge means, and is pivotable between a closed position where the upper lid covers the closing wall of the body, and an open position where the upper lid exposes the closing wall of the body, wherein an annular or arcuate groove is in an upper surface of the hanging wall and extends circumferentially in the hanging wall, wherein an axial breakable line extends axially in a part radially outward of the groove in the hanging wall, the axial breakable line being located, in a plan view of the top of the container, clockwise away from the hinge means, wherein, circumferentially, the body has a first break region, a second break region, and a third break region, and in the plan view of the top of the container lid, the first break region extends, counterclockwise, from the axial breakable line past the hinge means, and the second break region extends, counterclockwise, from the first break region to the third break region, wherein the groove has an axial depth in the first break region such that an axial thickness of the hanging wall in the axial direction is relatively small, an axial depth in the second break region that gradually increases such that the axial thickness of the hanging wall gradually increases, and an axial depth in the third break region such that the axial thickness of the hanging wall is relatively large, wherein, in at least the second break region and the third break region, a circumferential breakable line extending continuously and circumferentially along an axially lower end part of the groove is formed in the hanging wall, and wherein, in the first break region, an axially lower end of the groove is located below the locking means in the axial direction, whereas in the third break region, the circumferential breakable line is located above the locking means in the axial direction.

2. The synthetic resin container lid according to claim 1, wherein the first break region extends circumferentially over an angular range of 40 to 100 degrees, the second break region extends over an angular range of 10 to 30 degrees, and the third break region extends over an angular range of 140 to 300 degrees.

3. The synthetic resin container lid according to claim 1, wherein the axial thickness of the hanging wall in the first break region is no more than 1.0 mm, the axial thickness of the hanging wall in the second break region is 0.6 mm or more, and the axial thickness of the hanging wall in the third break region is 4.0 mm or more.

4. The synthetic resin container lid according to claim 1, wherein the axial thickness of the hanging wall sharply increases at a boundary between the first break region and the second break region.

5. The synthetic resin container lid according to claim 1, wherein, in the plan view of the top of the container lid, counterclockwise from the third break region, there is a non-break region where the groove has an axial depth such that the axial thickness of the hanging wall is larger than in the third break region.

6. The synthetic resin container lid according to claim 1, wherein in the second break region, the axial thickness of the hanging wall changes along an oblique line extending axially upwardly at an inclination angle of 20 to 60 degrees counterclockwise in the plan view of the top of the container lid, toward the third break region.

* * * * *